United States Patent [19]

Gorley et al.

[11] Patent Number: 4,737,129

[45] Date of Patent: Apr. 12, 1988

[54] ARTICLE CARRYING ARTIFICIAL VINE

[76] Inventors: John K. Gorley, Box 1, Jeff, Ky. 41751; Pauline Adkins, Box 146, Viper, Ky. 41774; Candice S. Slone, Box 4, Laffon Ct., Madisonville, Ky. 42431

[21] Appl. No.: 25,155

[22] Filed: Mar. 12, 1987

[51] Int. Cl.[4] ..... A41G 1/00; A63H 3/00

[52] U.S. Cl. ..... 446/72; 156/61; 428/16; 428/17; 428/21; 446/268

[58] Field of Search ..... 156/61; 428/16, 17, 428/21, 24, 25, 26; 446/72–75, 76, 268

[56] References Cited

U.S. PATENT DOCUMENTS

| | | | |
|---|---|---|---|
| 1,150,027 | 8/1915 | Gates | 428/26 X |
| 2,811,808 | 11/1957 | Briese | 446/72 |
| 2,896,352 | 7/1959 | Strauss | 428/21 |
| 3,369,811 | 2/1968 | Glass et al. | 428/17 X |
| 3,471,964 | 10/1969 | Cherry et al. | 428/24 X |
| 3,597,877 | 8/1971 | Speers | 428/24 X |
| 3,622,010 | 11/1971 | Renelt | 428/17 X |
| 3,644,164 | 2/1972 | Chin | 428/21 |
| 4,499,678 | 2/1985 | Moreau | 446/72 X |

*Primary Examiner*—Henry F. Epstein

*Attorney, Agent, or Firm*—Warren D. Flackbert

[57] ABSTRACT

An artificial vine, ornamental in appearance and form, arranged for carrying articles, where the latter, as a doll, for example, is selectively stored and removed from a pod which forms part of the artificial vine. The pods, which are also selectively removable from the stem of the vine, are each slitted so that, when open, a receiving cavity is presented. Opening may be accomplished by the use of a flexible material which resumes a closed position after release of flexing or, on the other hand, material which is readily movable from a closed to an opened condition, and conversely. In any event, whatever material is used should compliment the vine so as to present a total ornamental effect.

5 Claims, 1 Drawing Sheet

ARTICLE CARRYING ARTIFICIAL VINE

As is known, ornamentation plays significant importance in room design and arrangement, as, for example, in a child's room or in a playroom within a home. The combination of ornamentation with utilitarian functions would add even more importance to the preceding. In other words, a functional use of an ornamental item affords, at least, two-fold end results, to-wit, utility and appearance.

The invention satisfies the aforesaid objective in presenting an article carrying artificial vine. More specifically, an artificial, yet ornamental, vine, including a stem, leaves and elongated pods, is made available for decorative results, as by hanging on a wall in a child's room, a nursery, a family room or wherever. The invention further adds to the decorative and/or ornamental appearance by presenting the aforesaid elongated pods in a selectively openable relationship, i.e. by flexing or unfolding action, the wall of each pod is movable to present a receiving cavity, as for a doll or like child's plaything. Appropriately, the selectively encased, and removable, doll, can properly be identified as a "pea-pod" doll.

BRIEF DESCRIPTION OF THE DRAWINGS

The invention, therefore, combines utility with decorative capability, where a better understanding of the present invention will become more apparent from the following description, taken in conjunction with the accompanying drawing, wherein.

Figure 1:
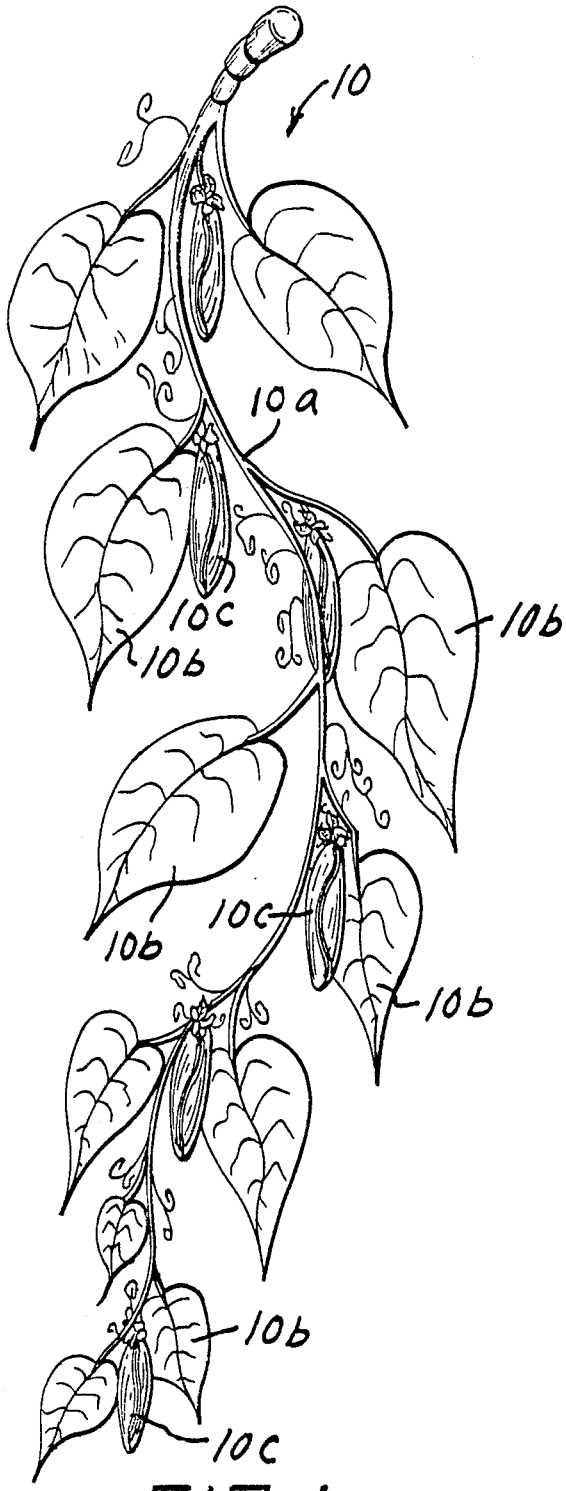
FIG. 1 is a plan view showing an artificial ornamental vine in accordance with the teachings of the present invention.

For the purposes of promoting an understanding of the principles of the invention, reference will now be made to the embodiment illustrated in the drawing and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

Referring now to the figures, and first to FIG. 1, a typical artificial ornamental vine 10 is illustrated, such including a stem 10*a*, a plurality of leaves 10*b* in various sizes representing differences in growth, and a series of pods 10*c*. The illustrated vine 10 is representative sizewise, where, for example, a pod 10*c* may extend to a 6 to 8 inch length.

In any event, the vine 10 is arranged for ready placement, when used, as on a wall, a flat post or wherever (none of which is shown). Importance lies in the fact, however, that the artificial vine 10 placement serves ornamentation at a desired location as, for example, within a home.

Figure 2:
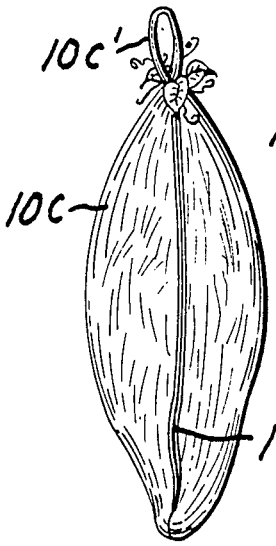
FIG. 2 is a view in front elevation, in an enlarged form, of a pod of the type illustrated in FIG. 1, with such pod in a closed condition.
Figure 3:
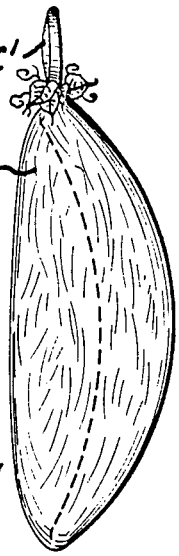
FIG. 3 is a view in side elevation, comparable to the pod of FIG. 2, but further detailing such, where the broken line represents a wall of the pod when moved to a flexed or opened condition; and, FIG. 4 is a greatly enlarged plan view of a pod of either FIGS. 1, 2, and 3, showing such, when opened, with a doll in the presented cavity.

FIGS. 2 and 3 show one of the pods 10*c* of FIG. 1, but in a larger presentation. Each pod 10*c*, in accordance with the invention, includes a carrying portion 10*c*′, such as a loop or hook, serving hanging purposes, and is slitted, at 10*c*″, typically vertically, i.e. along the longitudinal axis of the pod 10*c*.

As to material, each pod 10*c* may be made, for example, from fabric which is flexible and/or resilient for convenient return to an original condition. Water repellant or soil free material may be utilized and, for reasons to be discussed below, reinforcement (not shown) employed along the longitudinal slit 10*c*″ for added serviceability.

Figure 4:
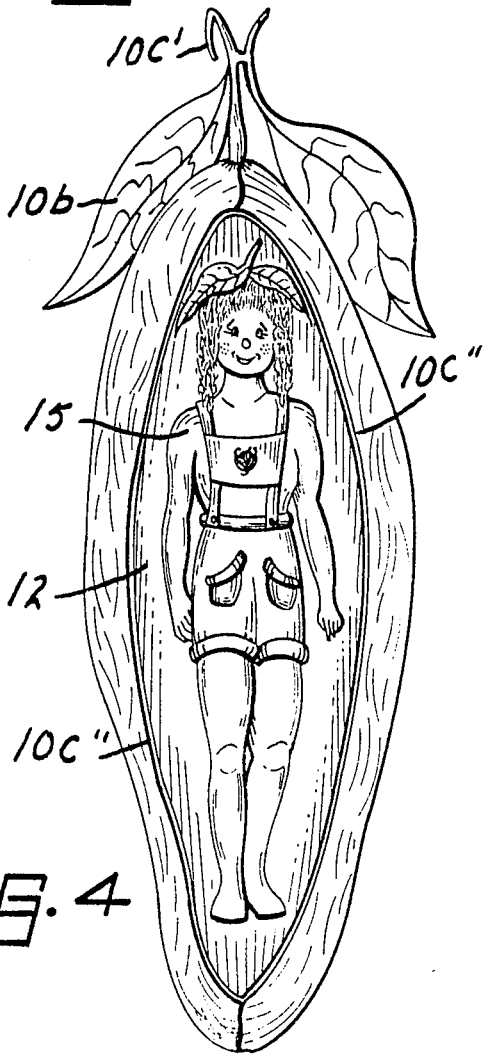

FIG. 4 is a showing of a greatly enlarged pod 10*c*, but at a flexed and/or opened condition, i.e. so as to present a cavity 12 for receiving a desired article 15, as the illustrated doll. In other words, the artificial vine 10 of the invention presents an arrangement for carrying or containing a series of articles 15 which may promote interest to a child, as the aforementioned doll, i.e. a collection of dolls, each doll within a cavity 12 defined by one of the pods 10*c*.

In operation, any desired pod 10*c* is flexed or otherwise opened, as by pulling apart the material adjacent the slit 10*c*″, so as to reveal the receiving cavity 12. Upon release, or by means of lateral movement, the slit 10*c*″ assumes the closed position of FIG. 2 and is representative of a conventional pod 10*c* found on a vine, bearing on the proposed possible identification of the carried unit as a "pea-pod" doll. The preceding can be accomplished with a pod 10*c* in position on the vine 10, or by removal of the pod 10*c*, by loop or hook 10*c*′, from the vine 10 (and then returned to the vine 10).

In other words, and by way of summary, an article carrying arrangement is achieved in the form of an artificial vine which presents a decorative effect and which, at the same time, presents ease in storage and/or removal of the article. The arrangement described above is, of course, susceptible to various changes within the spirit of the invention, including, by way of example the particular type or species of vine employed; the dimensioning and/or proportioning of a pod and the number of pods; the material utilized in forming each pod; the type or manner of hanging each pod onto the stem of the vine; overall proportioning of the article receiving cavity; the type of article stored for ready removal; the manner of pod entry and closure; and, the like.

Thus, the preceding description should be considered illustrative and not as limiting the scope of the following claims.

We claim:

1. An article of manufacture comprising an artificial hanging vine comprising a stem, leaf portions extending from said stem and an elongated pod extending from said stem, where said elongated pod is selectively openable to reveal a cavity which receives and stores a desired removable article, where said elongated pod includes a longitudinal slit to provide access to said cavity, and where flexing of said longitudinal slit of said elongated pod reveals said cavity.

2. The article of manufacture of claim 1 where said removable article is a doll.

3. The article of manufacture of claim 1 where means are provided for selectively and releasably hanging said elongated pod on said stem.

4. The article of manufacture of claim 3 where said means is a hook.

5. The article of manufacture of claim 3 where said means is a loop.

* * * * *